United States Patent [19]

Ragan

[11] 4,128,988

[45] Dec. 12, 1978

[54] APPARATUS FOR TWISTING AND WINDING STRAND MATERIAL

[76] Inventor: Ralph L. Ragan, 82 Sheridan Dr., NE., Atlanta, Ga. 30305

[21] Appl. No.: 731,093

[22] Filed: Oct. 8, 1976

[51] Int. Cl.[2] ..... D01H 1/26; D01H 1/00; D01H 7/02

[52] U.S. Cl. ..... 57/66; 57/71; 57/93; 57/100

[58] Field of Search ..... 57/67–71, 57/100, 92, 93, 94, 96, 66, 34 R

[56] References Cited

U.S. PATENT DOCUMENTS

| | | | |
|---|---|---|---|
| 1,412,518 | 4/1922 | Guildford | 57/93 |
| 1,846,715 | 2/1932 | Gegauff | 57/96 |
| 2,026,155 | 12/1935 | Abbott | 57/93 |
| 2,485,776 | 10/1949 | Roberts | 57/71 X |
| 2,610,461 | 9/1952 | Ragan | 57/67 |
| 2,820,336 | 1/1958 | Sagehomme | 57/71 X |
| 2,924,065 | 2/1960 | Geen | 57/100 X |
| 2,985,994 | 5/1961 | Menke et al. | 57/93 X |
| 3,325,985 | 6/1967 | Bucher | 57/93 |
| 3,345,813 | 10/1967 | Long | 57/96 |
| 3,449,901 | 6/1969 | Mackie | 57/71 |
| 3,782,097 | 1/1974 | Nakamura et al. | 57/96 |
| 3,848,405 | 11/1974 | Karlson | 57/71 |

*Primary Examiner*—John Petrakes
*Attorney, Agent, or Firm*—Lowe, King, Price & Becker

[57] ABSTRACT

An apparatus for twisting and winding strand onto a rotating bobbin comprises a spindle and an open top pot both mounted for coincident rotation about a common axis. A lower portion of the spindle extends outside the pot and is journalled in a set of low friction bearings. The bobbin is provided with a pair of sleeve bearings so that the bobbin is rotatable about the spindle. On the inner wall of the pot, a strand hook is provided to guide strand material onto the rotating bobbin. During operation, a strand is continually supplied to the apparatus at a constant lineal rate as the spindle and pot are rotated by a first motor thereby imparting twist to the incoming strand. The strand hook is axially reciprocated to traverse the strand along the length of the bobbin so as to distribute the strand in successive layers thereon. A second motor, mounted inside the pot, rotates the bobbin relative to the pot for winding the strand. A sensing device, inserted into the incoming strand and above the pot, continuously monitors the actual operating tension in the strand. This information is transmitted in the form of a voltage signal to an electronic control circuit. The circuit compares the signal with a fixed voltage reference signal corresponding to a preselected, fixed tension level. The control circuit immediately corrects any deviation between actual tension and desired tension in the strand by adjusting the speed of the second motor so as to cause the bobbin to wind the strand at a different rate.

25 Claims, 18 Drawing Figures

FIG 9a
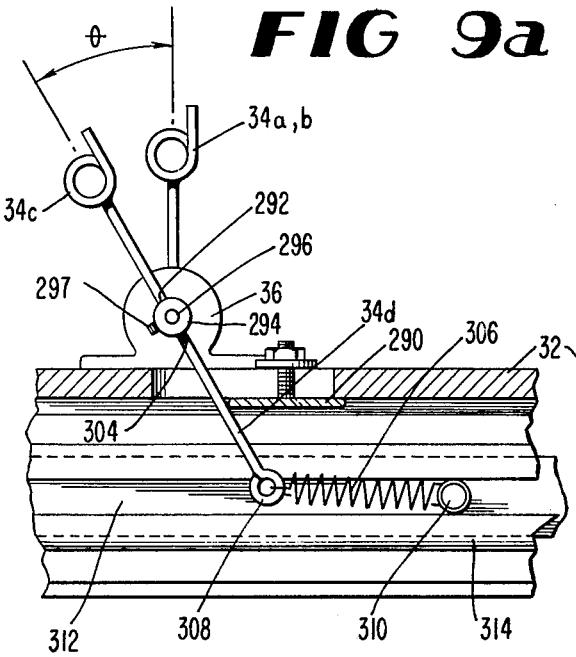
FIG 9b
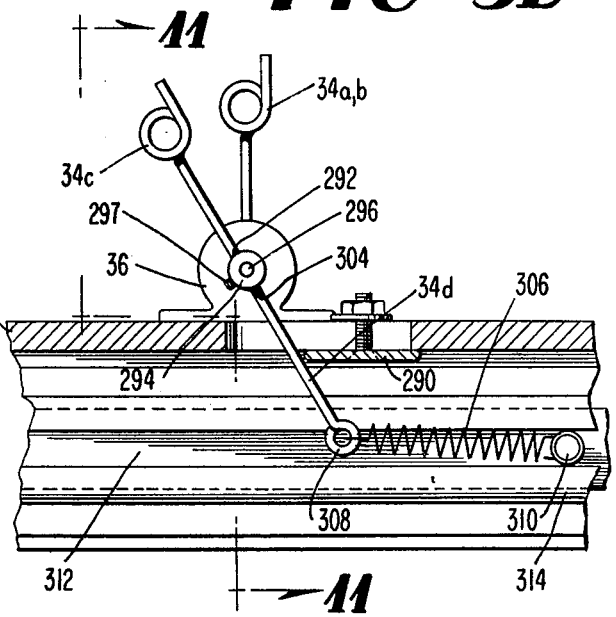
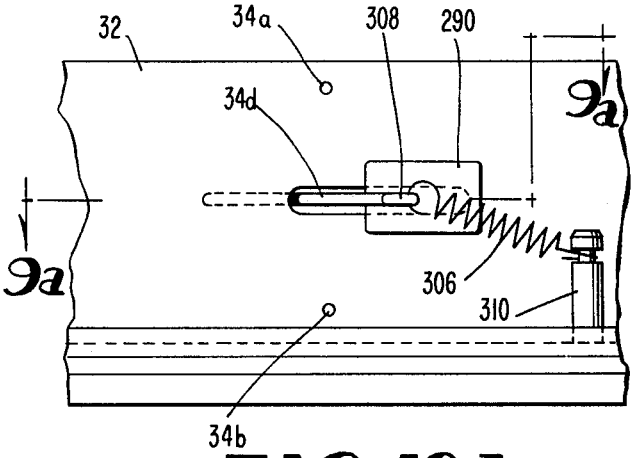
FIG 10b
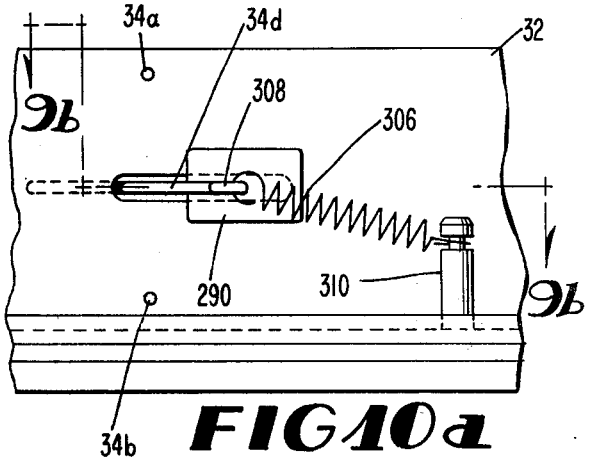
FIG 10a
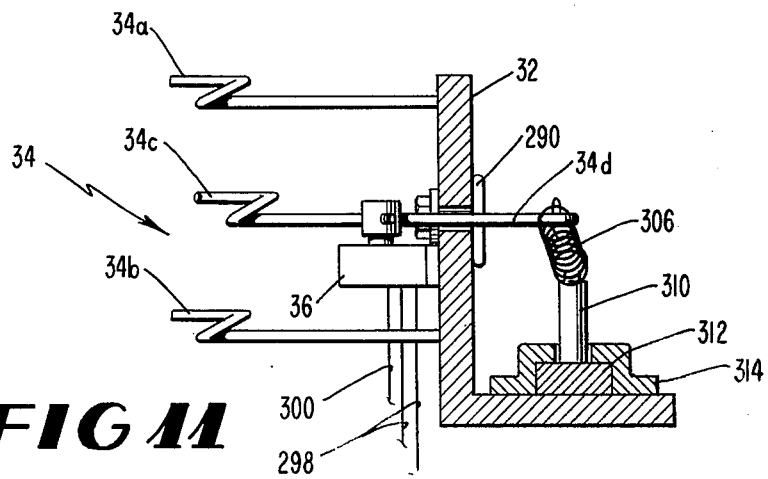
FIG 11
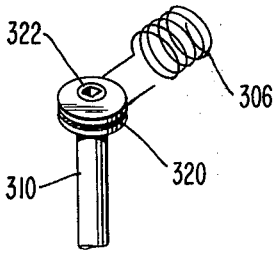
FIG 12

APPARATUS FOR TWISTING AND WINDING STRAND MATERIAL

BACKGROUND OF THE INVENTION

The present invention relates generally to an apparatus for twisting strand while winding the strand onto a rotating bobbin, and more particularly, to such an apparatus wherein the speeds of rotation of the bobbin and of a concentrically rotating strand hook are controlled to maintain a preselected strand tension.

In one widely used method of processing natural and synthetic fibers to form yarn, thread or other type of strand, sliver is supplied to a fly frame for transformation into a loosely twisted strand termed "roving." The roving is then supplied to a spinning frame where it is led through drafting rolls for transformation of the roving into strand having a diameter less than the diameter of the roving. The degree of attenuation or "draft" imparted to the roving depends on the type of yarn or thread being processed, e.g., finer yarns require a smaller diameter roving, and more draft.

After passing through the drafting rolls, the strand is fed through a strand guide to a rotating bobbin or spool onto which the strand is layered. The guide causes the strand to be supplied to the bobbin parallel to the axis of rotation thereof for twisting. Between the strand guide and bobbin, the strand passes through one type of twisting and winding apparatus known as a "ring and traveller," comprising a traveller slidably mounted on a ring located coaxially about the bobbin. As the strand is taken onto the rotating bobbin, the traveller, pulled by the strand, is caused to slide along the ring, orbiting the bobbin. Due to windage and friction, the speed of the traveller is somewhat less than the speed of rotation of the bobbin. The speed differential between the bobbin and traveller causes the strand to be wound onto the bobbin while the rotation of the traveller with respect to the fixed strand delivery rolls imparts twist to the incoming strand. The amount of twist imparted to the strand is determined by the lineal feed rate of the strand and the angular velocity of the revolving strand guide, e.g., traveller. Tension in the strand is determined by several factors, including traveller speed, friction, wind resistance and the angle of strand pull relative to the tangential path of the traveller.

During winding of the strand onto the bobbin, either the bobbin or the ring is made to reciprocate along the common axis of rotation. As a result, the strand is wound onto the bobbin in successive layers where each layer consists of strand which is laid onto the bobbin in a uniform helical pattern. This uniformity is achieved by synchronizing speed of rotation of the bobbin to the axial movement of the bobbin or ring.

In another type of twisting and winding apparatus, the strand is guided through a rotating flyer as the strand is wound onto the rotating bobbin. Both the bobbin and flyer rotate at a high rate of speed, but in conventional apparatus, the bobbin lags behind the flyer thereby winding the strand onto the bobbin. The flyer also imparts twist to the strand because one end of the strand is constrained from rotation at the point from which it is fed from the delivery rolls. In order to cause the strand to be wound onto the bobbin with uniform tension, the lineal speed of the strand as it is delivered to the bobbin must be maintained constant. Also, the lineal take-up rate of the bobbin must, at all times, equal this constant delivery rate. This requirement calls for a speed differential between the bobbin and flyer that is maximum as the first layer of strand is being wound onto the bobbin, and decreases with each successive layer. In the past, the speed differential has been stepwise decreased during each traverse of the bobbin using a cone drive and pulley belt-type of variable speed drive operating through relatively complex gearing. Each traverse causes an incremental shift of the pulley and belt and a corresponding change in the drive ratio and the bobbin drive and the flyer drive.

There still exists a need for an apparatus for twisting and winding strand onto a bobbin without the requirement of complex variable speed drive mechanisms, as is the case with flyer frames, and, in the case of ring spinning, without the requirement of using ring travellers, with all the problems attendant thereto.

OBJECTS OF THE INVENTION

Accordingly, a general object of the present invention is to provide a new and improved apparatus for twisting and winding strand onto a rotating bobbin.

Another object of the present invention is to provide a new and improved apparatus for twisting and winding strand onto a rotating bobbin at increased operating rates and full bobbin diameter.

Another object of the invention is to provide an apparatus for twisting and winding strand onto a bobbin wherein high wear parts such as travellers used on ring spinning and twisting frames are eliminated.

Still another object of the invention is to provide an apparatus for twisting and winding strand onto a bobbin wherein the incidence of strand damage or breakage is reduced by precisely controlling strand operating tension.

Yet another object is to provide an apparatus for twisting and winding strand onto a rotating bobbin wherein more compact "yarn packages" are wound by winding strand at tension levels just below the minimum breaking strength of the material being processed.

Still another object is to provide a new and improved apparatus for twisting and winding strand onto a rotating bobbin wherein absolute uniformity of twist throughout the length of the strand being processed is provided.

Another object is to provide an apparatus for twisting and winding strand onto a rotating bobbin wherein a diversity of stranded material can be accomodated.

Still another object is to provide an apparatus for twisting and winding strand onto a rotating bobbin wherein machine downtime is minimized by providing a capability of rapid changeover from one class of work to another.

BRIEF DESCRIPTION OF THE INVENTION

Briefly, in accordance with the invention, a vertical spindle, a lower portion of which is journalled in a set of low friction bearings, is coupled to a first motor for rotation of the spindle at a relatively high, fixed rate of speed. An upper portion of the spindle is located within a cylindrical, open top pot on the central axis thereof, and the pot and spindle are coupled together for common rotation.

A bobbin provided with a pair of sleeve bearings is mounted for rotation on the spindle. Below the bobbin within the pot, a second motor is seated with its stator secured to the base of the pot and its rotor in driving engagement with the bobbin. Rotation of the spindle and pot therefore causes the stator of the second motor to rotate. Rotation of the rotor of the second motor relative to the stator thereof causes the bobbin to rotate at a speed different from the speed of the pot. In operation, the pot and bobbin both rotate at a relatively high rate of speed, and there is also relative rotation created between the bobbin and the pot. The speed of the relative rotation is controlled by the second motor.

Strand such as yarn, thread or fiber, is directed by guide members from a pair of delivery rolls to a strand hook located on the wall of the open top pot. The strand hook guides strand to the bobbin parallel to the axis of rotation of the bobbin. The strand path consists of an arcuate vertical leg and a straight horizontal leg where the strand, in travelling through the vertical leg of the path, first leaves the delivery roll at a point above the bobbin and generally coincident with the axis of rotation thereof. The strand then extends downwardly while gradually curving outwardly into a path which is generally parallel to the central axis of the bobbin and at a radial distance therefrom equal to that of the strand hook. The vertical leg terminates at the point where the strand passes under the strand hook. The strand then travels inwardly and tangentially onto the winding surface of the bobbin, thus completing the horizontal leg. During winding, the hook reciprocates axially with respect to the bobbin. The strand hook therefore guides the strand into layers on the rotating bobbin. Twist is simultaneously imparted to the strand because the strand hook is revolved with respect to the fixed strand delivery point.

In one embodiment, the strand hook is attached to one end of a flexible strip slidably contained in a vertical channel formed in the inner wall of the pot. The flexible strip extends downwardly within the channel, and toward the center through radial channels in the base of the pot, and upwardly through a central bore in the spindle. The opposite end of the strip is secured to a push-rod within the bore. As the push-rod is reciprocated within the bore of the spindle, the strand hook (through the flexible strip) is correspondingly reciprocated on the wall of the pot. During rotation of the pot, the push-rod is reciprocated by moving the rail located beneath the spindle, so that the strand hook traverses the bobbin to impart both the axial and rotary motions required for twisting and winding the strand onto the bobbin in uniform successive layers.

In another embodiment, the strand hook is fixed to the wall of the open top pot which is mounted for rotation in a suitable bearing structure. The bearing structure in turn is mounted to a reciprocating rail located above the spindle bearing structure as previously described. Thus mounted, the pot can be reciprocated axially during winding.

In both embodiments, the difference between the speed of rotation of the bobbin and the speed of rotation of the pot, determined by the rotor of the second motor, is controlled by a tension sensing device. The tension sensing device comprises three strand guide arms formed of a pivotal guide arm mounted between a pair of stationary guide arms. The distal end of each arm has a pig-tail for retaining moving strand. The pivotal arm is mounted on the shaft of a rotary potentiometer, and is normally biased out of alignment with the stationary arms by a spring. Strand passing through the three arms tends to urge the pivotal guide arm into alignment with the stationary arms against the force of the spring.

The force of the strand tending to return the pivotal guide arm into alignment with the stationary arms is related to strand tension. Strand tension is calibrated by adjusting the pull of the spring so that it exerts a force on the pivotal guide member equal to a restoring force corresponding to a known strand tension. As a result, tension of the strand is known by monitoring the output resistance of the potentiometer.

As stated above, tension in the strand being wound onto the bobbin is controlled by controlling the speed of rotation of the second motor. The tension of the strand is converted by the potentiometer into a d.c. voltage as a function of the rotational position of the shaft or wiper of the potentiometer. This d.c. voltage is compared to a reference voltage corresponding to a desired strand tension. Any difference between the reference voltage and the potentiometer voltage is developed as a control voltage. This control voltage, after amplification, is applied to a velocity control circuit that controls the speed of the rotor of the second motor. Rotor speed is monitored by a tachometer mounted in the stator that generates a voltage proportional to motor speed. In response to these voltages, the velocity control circuit controls the speed of the second motor to cause the actual strand tension to be equal to the desired strand tension.

A set of slip rings for supplying drive current to the second motor is disposed on the outer surface of the base of the pot. A set of stationary brushes, connected to the output of the velocity control circuit, is maintained in sliding contact with the slip rings. The feedback signal indicative of rotor speed is supplied to the control circuit via another set of stationary brushes in contact with slip rings on the outer wall of the pot.

Within the second motor, another set of brushes is maintained in sliding contact with conductors printed on the rotor. The brushes are seated on special leaf-spring mounts that maintain a constant pressure between the brushes and rotor independent of motor speed.

Still other objects and advantages of the present invention will become apparent to those silled in this art from the following detailed description wherein I have shown and described only the preferred embodiments of the invention simply by way of illustration of the best modes contemplated by me of carrying out my invention. As will be realized, the invention is capable of other and different embodiments, and its several details are capable of modifications in various obvious respects, all without departing from the invention. Accordingly, the description and drawings are to be regarded as illustrative in nature and not as restrictive.

BRIEF DESCRIPTION OF THE DRAWINGS

FIGS. 9(*a*) and 9(*b*) are detailed views of portions of the horizontal support rail showing the calibration bar located respectively in two different calibration positions;

FIGS. 10(*a*) and 10(*b*) are views of the horizontal support rail taken along the line 10—10 in FIGS. 9(*a*) and 9(*b*);

FIG. 11 is a cross-sectional view of the rail taken along the line 11—11 in FIG. 9(*a*);

FIG. 12 is a perspective view of an adjustable spring-holding member for fine calibration of spring tension;

DETAILED DESCRIPTION OF THE SPECIFIC EMBODIMENTS

Figure 1:
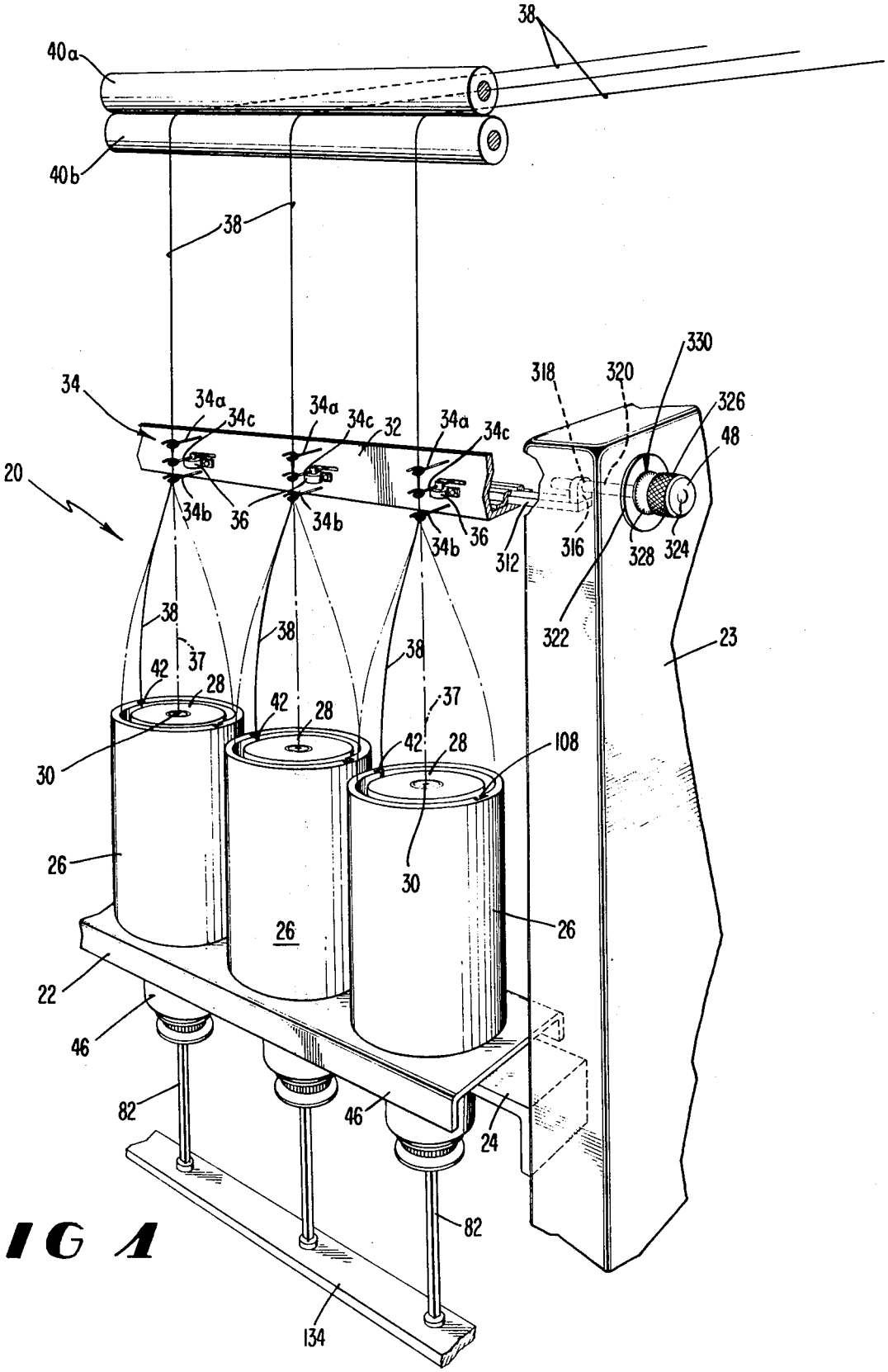
FIG. 1 is a perspective drawing of three bobbins being wound with strand within open top pots in accordance with one embodiment of the invention.

Referring to FIG. 1, an apparatus for twisting and winding strand onto a rotating spool in accordance with one embodiment of the invention, is shown generally by 20. Apparatus 20 includes a horizontal support rail 22 mounted to opposite ends of parent machine 23 (only one side of machine 23 is shown) with a mounting bracket 24. Rail 22 supports a plurality of open top pots 26 containing strand receivers or bobbins 28 rotatably mounted on spindles 30. Also extending between the opposite ends of parent machine 23 is a horizontal rail 32 carrying a set of strand guide members indicated generally by 34 directly above each of the open top pots 26. Each set of members 34 includes a pair of stationary guide arms 34*a* and 34*b*, and a tension arm 34*c* mounted to a rotary potentiometer 36 between the stationary arms.

With respect to each pot 26, a strand 38 such as yarn, thread or fiber, is drawn from a strand source (not shown) through a pair of delivery rolls 40*a*, 40*b* vertically downwardly through the pig-tail ends of guide members 34. In the region between the members 34 and the rolls 40*a*, 40*b*, strand 38 is generally coincident with the axis of rotation 37 of bobbins 28. In the region between each bobbin 28 and guide members 34, on the other hand, strand 38 gradually curves outwardly into a path that is generally parallel to the axis of rotation 37 and then into a channel 42 on the inner wall of open top pot 26.

Within each open top pot 26 (see FIG. 2) strand 38 passes under a strand hook 44 and travels inwardly and tangentially onto the winding surface of the bobbin 28. In accordance with the invention, and as described in detail below, strand 38 is continually supplied to apparatus 20 at a constant lineal rate and twist is imparted to the incoming strand as spindle 30 and pot 26 are rotated by a first motor (not shown) through a cogged belt and pulley arrangement 45. Strand hook 44 is axially reciprocated to traverse strand 38 along the length of the bobbin 28 so as to distribute the strand in successive layers thereon. A second motor 47, mounted inside pot 26 beneath bobbin 28, rotates the bobbin relative to the pot for winding the strand 38. Tension in strand 38 is monitored by guide members 34 in the strand path. The potentiometer 26 is rotated by guide arm 34*c* as a function of strand tension, and develops a d.c. voltage signal that is compared to a reference d.c. voltage signal representing a desired strand tension. Any error between the monitored tension and reference tension is used to control the speed of rotation of motor 47 so as to cause the monitored strand tension to be equal to the reference strand tension. The output of potentiometer 36 is calibrated via a manual adjustment knob 48 (FIG. 1) on parent machine 23. Calibration of all guide members 34 corresponding to the open top pot 26 is made simultaneously with a single adjustment of the knob 48, but if individual fine adjustment should be required for each tension arm 34*c*, it can be made during initial set-up by using an eccentric member 320 (FIG. 12) in lieu of non-adjustable spring anchor or stud 310 (FIG. 10).

Referring to FIGS. 2–5 in detail, spindle 30 is vertically positioned or journalled in a ball bearing spindle cartridge or bolster 46 of a type well known in the art. Bolster 46 is mounted in the bore 48 of support rail 22, and is secured therein by a retaining nut 50 and washer 52. Open top pot 26 is mounted coaxially with spindle 30, and is suitably secured for rotation therewith by a key 54 seated in a hub 56 formed integrally with the pot 26.

A cogged pulley 58 is suitably secured by set screw 60 to a lower extremity of spindle 30. The pulley 58 engages a cogged drive belt 62 and derives from the linear motion thereof a rotary motion which is imparted to spindle 30 and the co-rotating elements thereof.

Bobbin 28 is mounted coaxially with and rotatably on spindle 30. Sleeve bearings 64 and 66 are press-fitted in respective counterbores (not numbered) in the bobbin 28. Axial support for bobbin 28 is provided by a spring ring retainer 68 seated in a groove (not numbered) in spindle 30.

Motor 47, which will be described in more detail below, in conjunction with FIG. 5, includes a stator 70 secured to a lower portion of the inside surface of pot 26 just beneath bobbin 28, and a disc armature 72 for rotating the bobbin 28.

A hub 74 is provided with an integrally formed flange and the disc armature 72 is suitably secured to the underside of the hub. Two diametrically opposed driving projections or lugs 76 are located on and formed integrally with the flange of the hub 74. The lugs 76 engage slots 78 formed in the bottom of bobbin 28.

Figure 2:
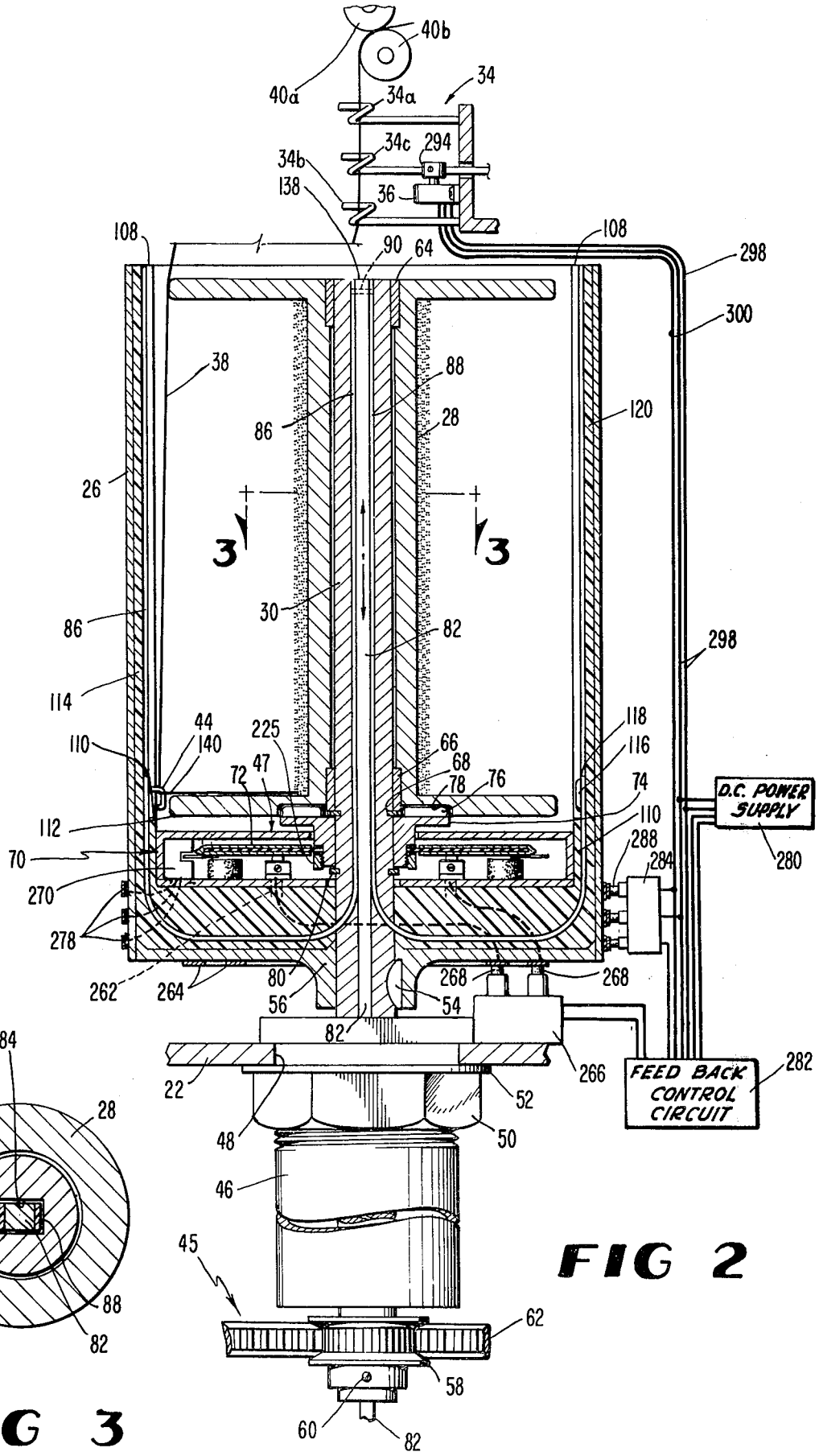
FIG. 2 is a cross-sectional side view of one of the open top pots of FIG. 1 with the strand hook in a lower position and with electrical wiring and control shown schematically.
Figure 3:
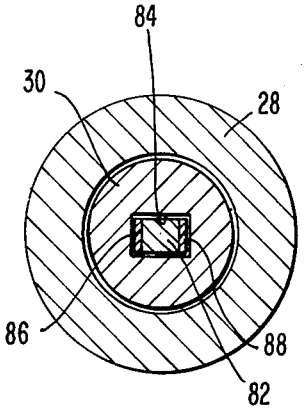
FIG. 3 is a horizontal cross-sectional view of the bobbin and spindle viewed along the line 3—3 in FIG. 2.

Still referring to FIG. 2, a push-rod 82 is contained within a bore 84 (see also FIG. 3) which extends through the longitudinal center or axis of rotation of spindle 30. An upper portion of bore 84 is rectangular in cross-section, and the geometric center thereof coincides with the axis of rotation of spindle 30. The lower portion of bore 84, however, is square in cross-section, and the geometric center also coincides with the axis of rotation of spindle 30. The transition from a rectangular cross-section to a square cross-section is identified by 85 in FIG. 4.

The principal length of push-rod 82 is square in cross-section and is sized so as to fit closely, yet slide easily in the square portion of bore 84 as described above. Square push-rod 82, as it extends upwardly into the rectangular portion of the bore 84 leaves two gaps or rectangular openings, each filled by elongated flexible strips 86 and 88. Strips 86 and 88, which are equal in length and made from any suitable material, e.g., a polymeric material, such as nylon, extend downwardly along opposite sides of push-rod 82 from the upper end of the spindle downwardly to points 92 and 94 (FIG. 4) respectively. Strips 86 and 88 are fastened to push-rod 82 by pin 90.

Figure 4:
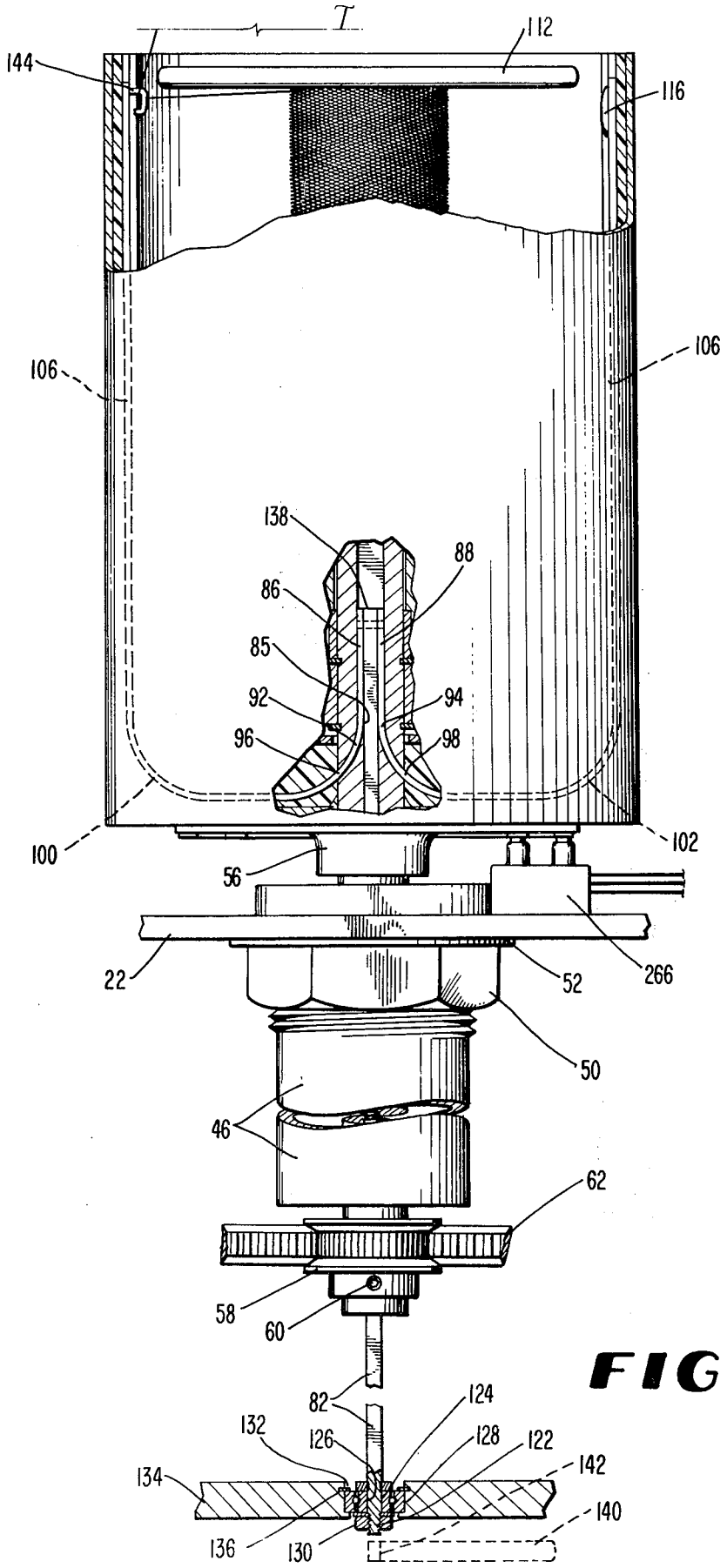
FIG. 4 is a side view of the open top pot with an upper portion broken away to expose the strand hook in an upper position, and a lower portion broken away to expose the push-rod.

At points 92 and 94, the strips 86 and 88 respectively exit through the wall of spindle 30 through diametrically opposed curved side ports 96 and 98. From ports 96 and 98, the strips 86 and 88 enter guideways 100 and 102 (FIG. 4). The guideway 102 presents a generally J-shaped profile, wherein the vertical leg of the "J" is contained in the vertical wall of pot 26 and the hooked end of the "J" is in registration with the side exit port 98 and forms a smooth continuation of the internal surfaces thereof. The guideway 100, on the other hand, is opposite and typical with respect to the guideway 102.

Guideways 100 and 102 are uniformly rectangular in cross-section, and the rectangle defining each cross-section is substantially equal in size and shape to the typical rectangles (not numbered) which define the equal openings that exist on each of the opposite sides of push-rod 82.

Diametrically opposed slots 108 (FIG. 2) are formed vertically in the inner wall of pot 26, and each is contiguous with and opens into vertical guideways 106 (FIG. 4). Slots 108 open into the guideways 106 forming a T-slot configuration which can best be seen in FIG. 1. The slots 108 extend from points 110 (FIG. 2) upwardly to the upper rim of pot 26 (points 110 are located in the inner wall of the pot 26 and are substantially the same height as the bottom surface 112 of bobbin 28).

Strand hook 44 is press-fitted into a hole (not shown) substantially near the free end 114 of strip 86 and projects through slot 108. Bob weight 116 diametrically opposed to strand hook 44 is attached near the free end 118 of strip 88. The bob weight 116 serves as a counterbalancing means against the strand hook 44.

Although the guideways 106 (FIG. 4) are shown as being cast as integral features of an inner pot liner 120 which is cast in place and comprises a vertical hollow cylinder portion and a transverse bottom portion integral therewith, it is to be understood that the guideways could alternatively be formed as sheet metal tubular structures welded to the walls of the pot. The liner 120 may be cast from any one of a number of suitable castable materials. For example, a suitable resin formulation may be used to advantage in view of the capability of resin to reproduce the details of a master model with great fidelity.

It was stated above that the principal length of push-rod 82 is square in cross-section. Referring to FIG. 4, however, a minor portion of the length of push-rod 82 which is contiguous to the lower end 122 of the push-rod is formed as a round neck 124 of sufficient length to project through the bore 126 of an anti-friction bearing 128. The diameter of neck 124 closely fits the bore diameter of bearing 128, but the neck diameter is slightly less than the width of a typical side of the square which defines the principal cross-sectional of the push-rod 82. Thus, sizing the diameter of the neck 124 creates a shoulder which is abutted by the upper axial face of the bearing 128.

The lower axial face of the bearing 128 abuts a retainer nut 130 which is threaded onto the lower end 122 of the push-rod 82. The bearing 128 is journalled into a counterbore 132 in a rail 134 (below fixed rail 22), and is axially retained therein by a spring ring retainer 136 seated in a groove (not numbered). The rail 134, which extends the full length of the parent machine 23, is arranged to execute a reciprocating motion. The means of imparting reciprocating motion to rail 134 is not described herein since, in practical machines of the class described, some known form of rail reciprocating means is employed, e.g., any type of transversing mechanism used in conventional ring twister frames to reciprocate the ring rail thereof.

In operation, referring first to FIGS. 2 and 4, with rail 134 in its top-most position (FIG. 4), push rod 82 is in like position, with the upper end 138 of the push-rod in approximate axial registration with the upper end of spindle 30. Note, however, that while the push-rod 82 is thus in its top-most position, the strand hook 44 and bob weight 116 concurrently are in their lowermost positions, i.e., the strand emergence point 140 of the strand carrying hook 44 is ineffective registration with the lowest available strand take-up point on the bobbin 28, as shown.

As the rail 134 moves downwardly, the push-rod 82, which is axially linked to the rail 134, also moves downwardly carrying the attached strips 86 and 88 downwardly within rectangular bore 84. As a result, the strips 86 and 88 are forced outwardly and downwardly through the respective side exit ports 96 and 98 and into the adjoining J-shaped guideways 100 and 102. Within the guideways 100 and 102, the strips 86 and 88 move first through the hooked portion of the "J," and then upwardly in the vertical leg thereof with the strips thus simultaneously carrying the strand hook 44 and bob weight 116 upwardly in the opposed slots 106.

In FIG. 4, when the rail 134 and push-rod 82 have completed their downward stroke, with the rail at its lowermost position 40 (shown in phantom) and the push-rod 82 at its lowermost position 142 (also shown in phantom), the strand hook 44 is at its top-most position 144, thus completing one half of a reciprocatory cycle. As the subsequent upstroke of the rail 134 and push-rod 82 commences to completion, the reverse condition will appear, i.e., where the upper end 138 of the push-rod 82 is once again in its topmost position (in registration with the upper end of the spindle) and the strand hook 44 is once again in its lower-most position. This, of course, is the condition that existed at the beginning of the cycle, as described.

It can be seen that the strand traversing operation is then, in essence, one in which a push-rod, in executing a downstroke, forces a cooperating strand hook, through driving means in the form of a flexible strip to execute a simultaneously and precisely equal upstroke; then the push-rod reverses to an upstroke and the operation is reversed. Obviously, the downstrokes and upstrokes of the push-rod and strand hook, as described, are mutually equal as well as equal to the height of the yarn package or in this case, the distance between the upper and lower flanges of the bobbin. The latter equality is achieved by appropriate adjustment of the traversing mechanism, of known form, which controls the movement of rail 134.

Figure 5:
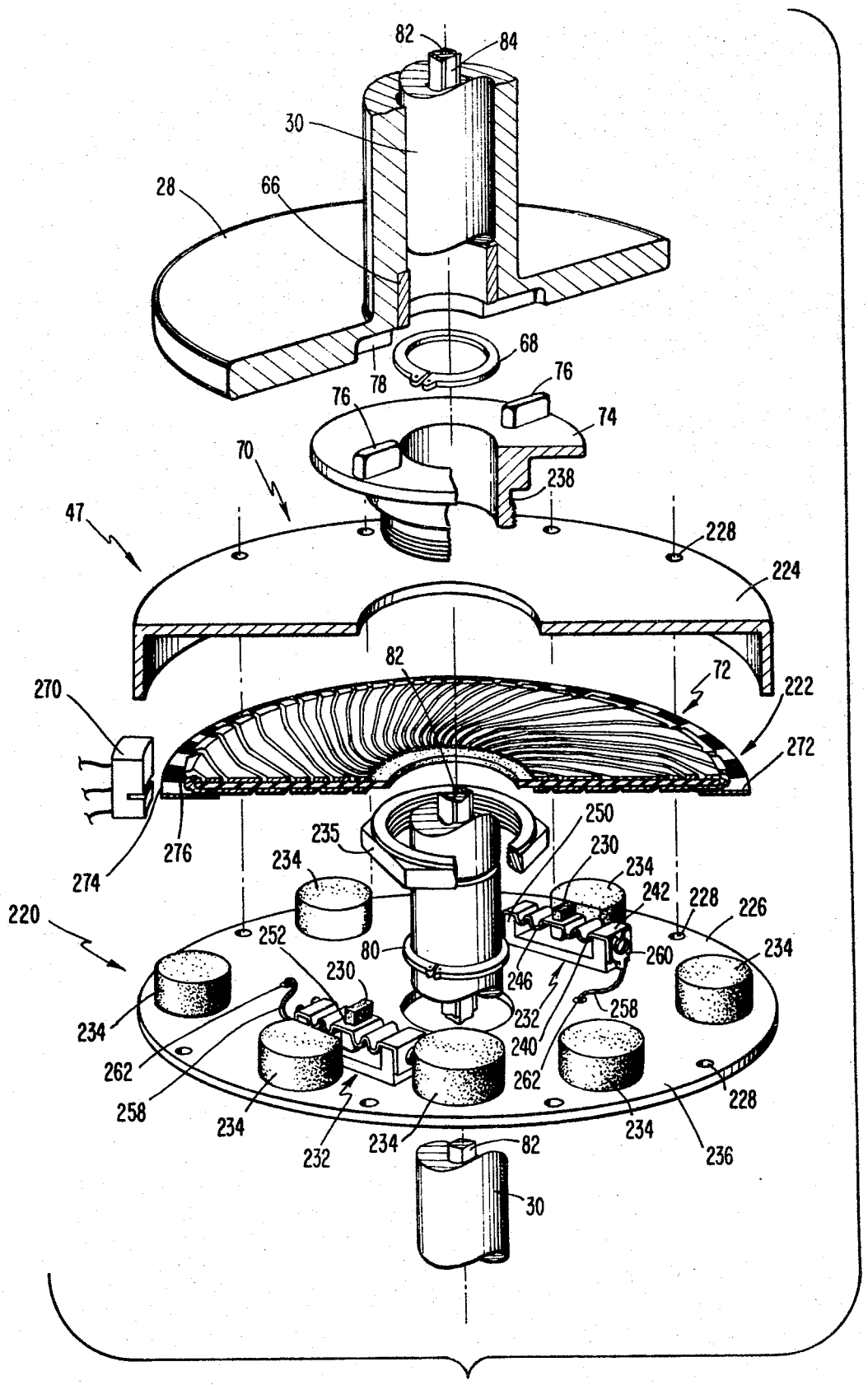
FIG. 5 is an exploded view of the pancake-type, d.c. motor within the open top pot in FIGS. 1–4 exposing the special leaf-spring mounts for the rotor brushes.

A detailed description of one embodiment of motor 47 shall now be provided with respect to FIG. 5. While motor 47 shall be described herein as being a disc armature type d.c. motor, it is to be understood that this illustration is not to be construed as limiting. Numerous types of motors could alternatively be employed in the present invention for causing controlled relative rotation between the bobbin and spindle, such as stepping motors, torque motors, synchronous motors, or moving coil motors. Each motor type has certain characteristic advantages and disadvantages. An ideal motor for use in practical spinning machines of the present type is envisioned as one having high efficiency, high power output to weight ratio, small axial length in relation to diameter and ease of speed control.

Control circuits for regulating the speed of a disc armature, d.c. motor, and a stepper motor, are described in detail below. It is also to be understood that other types of control circuits could be used for controlling the respective motors and that suitable control circuits for other types of motors are well known to those skilled in the art and need not be described herein.

Referring to FIG. 5, electric motor 47 includes a field structure, denoted generally as 220, and an armature structure denoted generally as 222. The field 220 and armature 222 are located coaxially with spindle 30, adjacent to and beneath bobbin 28.

Field structure 220 includes an upper end bell 224 and lower, disc-like end bell 226, both made of a suitable magnetically permeable material. The end bells 224, 226 are suitably secured to the bottom of pot 26 (FIG. 2) by a set of machine screws (not shown) extending through equally circumferentially spaced holes 228.

The field structure 220 also includes a pair of commutating brushes 230 each mounted in a holder 232 (described in detail below). A set of permanent magnet pole pieces 234 (eight pieces are shown for illustrative purposes) are adhesively bonded to the inside face 236 of lower end bell 226.

In the construction of armature structure 222, hub 74 is provided with screw threads 238 which accomodate retaining nut 235 which, in turn, secures disc armature 72 to hub 74. The construction of disc armature 72 is of a type known in the art, such as described in U.S. Pat. No. 3,144,574. Located on the flange face of the hub 74, and integrally formed therewith, are the two diametrically opposed driving lugs 76 which engage slots 78 in the bottom of bobbin 28. Spring retainers 68, 80 are seated in grooves (not numbered) on the outside circumference of spindle 30 and serve to prevent axial movement of the armature structure 222.

The brush holders 232, referred to above, are shown in FIGS. 2, 4 and 5. Prior to a more detailed description of the holder 232, however, it should first be noted that the holder is required to operate reliably while moving in an orbital path at a high rate of rotational speed. In conventional applications, holders that are employed almost invariably operate in a stationary motor frame. In the latter case, quite satisfactory commutation may be achieved using a spring-urged brush in a suitable housing. In the present case however, were such a conventional arrangement to be employed, the high operating speeds or centripetal forces of large magnitude associated therewith would cause the brush to lock in its housing thereby interferring with proper commutation. The design of the present brush holder eliminates the aforementioned difficulty.

Still referring to FIG. 5, a convoluted leaf spring 242 on each holder 232 has two sets of lateral convolutions 240 and 246, and is secured to an insulating mounting yoke 250 using a pair of screws (not numbered). A pocket 252, formed integrally in the spring 242, is centered between the convolutions 240 and 246, and is substantially longitudinally parallel therewith.

Seated in the pocket 252 is a carbon brush 230 which fits the pocket 252 closely enough to make good electrical contact therewith. A conductor 258 has a terminal lug 260 which is secured under the head of the screw, as shown, thereby making electrical contact with the brush 230 and spring 242.

The spring 242 is constructed so that in its free state, the spring will be bowed upwardly, but when downward pressure is applied to the brush 230, the spring 242 will tend to flatten out while simultaneously reacting upwardly, thereby extering an axial pressure through the brush to the commutating surface. Such reaction, through careful spring design, can be controlled in magnitude so as to provide the optimum brush pressure which is needed for good commutation. Moreover, since the line of action of the centripetal force acting on the center of mass of the brush 230 is generally coincident with the plate-like body of the spring 242, and since there is no sliding contact between the brush and its containing structure, it can readily be seen that the brush holder 232 will operate even though a substantial centripetal force were to impinge thereon.

The conductors 258 lead downwardly through holes 262 in the lower end bell 226 and in the bottom section of the pot (see FIG. 2) and then to slip rings 264 to which the wires are electrically connected.

Slip rings 264 (FIG. 2) are secured to the outside bottom of pot 26 and are concentric with spindle 30. Mounted below and adjacent the slip rings 264 is a generally conventional brush holder assembly 266 which carries spring-urged brushes 268 in sliding contact with the slip rings. The brush holder assembly 266 is fixedly mounted on the support rail 22.

Referring to FIG. 5, the speed of rotation of armature structure 222 relative to the field assembly 220 of motor 47 is monitored by a conventional lamp and photocell tachometer 270 mounted against the inner surface of the cylindrical wall of the upper bell 224 (see also FIG. 2). Armature 72 carries a circumferential ring 272 having a series of alternate transparent and opaque regions equally spaced therealong. The opaque and transparent regions, indicated respectively as 274 and 276, alternately block and pass light between a lamp and photocell pair (not shown) within the tachometer 270.

Referring to FIG. 2, electrical conductors extend between the tachometer 270 and slip rings 278 on the outer surface of the cylindrical wall of pot 26. The conductors and slip rings 278 supply current from a d.c. power supply 280 to the tachometer so as to energize the lamp and bias the photocell contained therein and conduct the on and off signal generated by the photocell to a feedback circuit 282. A conventional brush assembly 284 is suitably mounted with spring-biased brushes 288 in sliding contact with the slip rings 278.

Figure 7:
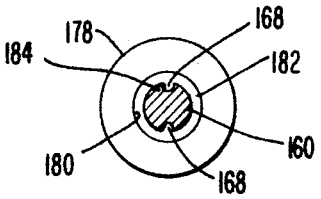
FIG. 7 is a cross-sectional view of the assembly of FIG. 6 taken along the line 7—7.
Figure 8:
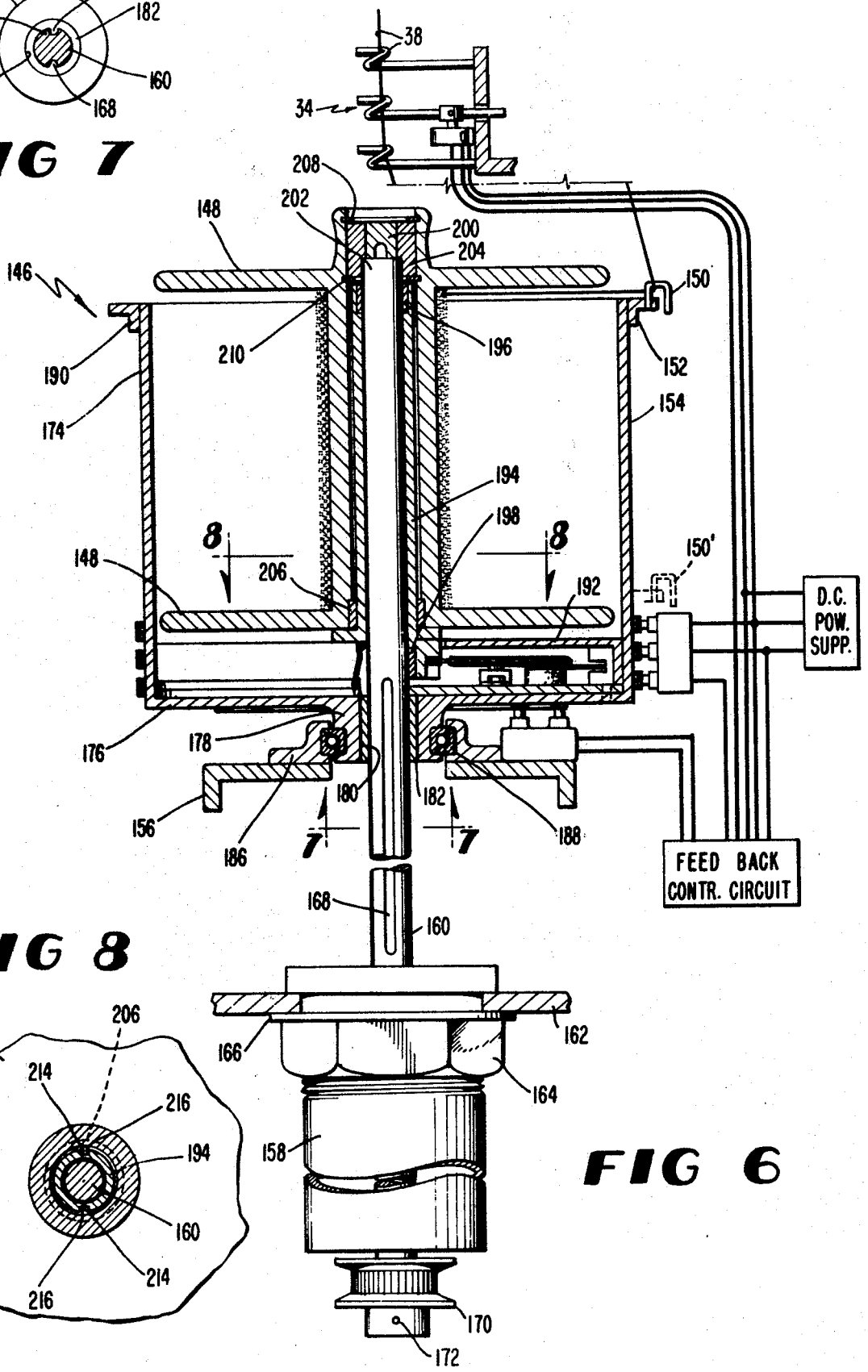
FIG. 8 is a cross-sectional view of the assembly of FIG. 6 taken along the line 8—8.
Figure 6:
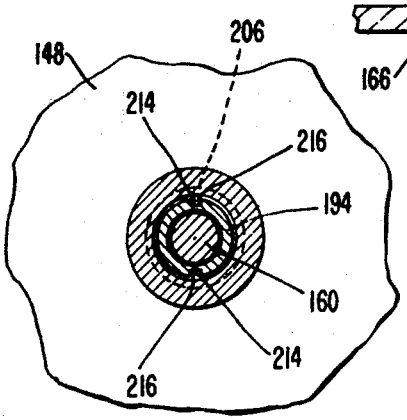
FIG. 6 is a cross-sectional view of a bobbin and open top pot for winding strand onto the bobbin incorporating a d.c. motor similar to the motor of FIG. 5 in accordance with another embodiment of the invention.

A second preferred embodiment of a strand guide traversing mechanism, in accordance with the invention, is shown in FIGS. 6–8 and identified generally by 146 in FIG. 6. As shall become apparent from the following description, strand traversing mechanism 45 described in connection with FIGS. 1–4 differs from mechanism 146 in FIG. 6 to the extent that in mechanism 146, strand 38 is traversed along the length of bobbin 148 by a strand hook 150 press-fitted into the rim 152 of open top pot 154. A reciprocating open top pot 154 is provided in FIG. 6 in lieu of the flexible strips 86 and 88 in FIGS. 2–4. As another significant difference, the vertical reciprocating function of strand hook 150 in FIG. 6 is provided by a rail 156 located above bolster 148, whereas in FIGS. 1–4, the vertical reciprocating function of strand hook 44 is provided by rail 134 (via strips 86 and 88) located below bolster 46.

Referring now to FIG. 6 in more detail, a spindle 160 is journalled for rotation in bolster 158 that in turn is mounted to a stationary horizontal platform 162 by a nut 164 and washer 166. The bolster 158 is of a type well known, and is similar to bolster 46 shown in FIG. 2. A lower portion of the spindle 160 contains a pair of opposed, longitudinal splines 168 (see also FIG. 7).

A lower extremity of the spindle 160 is secured to a cogged pulley 170 with a set screw 172. Spindle 160 is rotatable within the bolster 158 by means of a cogged belt (not shown) in engagement with the pulley 170 in a similar manner as described with respect to the embodiment of FIGS. 1–4.

Open top pot 154 includes a cylindrical sidewall 174 and a circular base. Integrally formed to the base 176 is a hub 178 having a central bore 180 (refer also to FIG. 7). A sleeve 182 is secured to hub 178 within bore 180 and includes an opposed pair of guide members 184 (shown only in FIG. 7) in sliding engagement with splines 168. The hub 178 is mounted to a collar 186 with low friction ball bearing 188. The collar 186 in turn is mounted on the rail 156.

It can thus be appreciated that the pot 154 is caused to rotate with spindle 160 as a result of the engagement between members 184 in sleeve 182 and splines in spindle 160. It can further be appreciated that during rotation, pot 154 is free to reciprocate vertically with members 184 sliding within splines 168 during reciprocation of the rail 156.

The mechanism for reciprocating rail 156 is not disclosed herein for the sake of brevity. Such a mechanism is well-known to those of oridinary skill in the art as discussed above with respect to rail 134 in FIGS. 1–4.

At the upper rim of pot 154, a layered lip 190 contains the strand hook 150 press-fitted therein. Strand hook 150 guides strand 38 into layers on bobbin 148, as described in detail below.

A motor 192, which may be a "pancake-type" motor, and is similar to motor 47 in FIG. 2, is mounted inside pot 154 on base 176. The motor 192 includes a long, hollow output shaft 194 concentrically disposed around the spindle 160. Upper plain bearing 196 and lower plain bearing 198 are located between the motor shaft 194 and spindle 160.

Bobbin 148 is mounted on the shaft 194 and is axially retained by permanent magnet 200 at the top of bobbin 148 in abutment with the upper end 202 of the spindle 160. The bobbin 148 contains a bearing member 204 in contact with the upper end 202 of spindle 160 and a driving member 206 in contact with motor shaft 194. Members 200 and 204 are retained within bobbin 148 by an upper washer 208 and a lower washer 210.

Bobbin 148 is coupled to rotate with motor shaft 194. Referring to FIG. 8, driving member 206 contains an opposed pair of longitudinal projections 214, and the outer surface of motor shaft 194 contains a corresponding, opposed pair of splines or channels 216. Accordingly, due to the coupling, rotation of the motor shaft 194 causes a corresponding rotation of bobbin 148 about spindle 160. During rotation of spindle 160 by an external motor (not shown) which rotates cogged pulley 170 there is also rotation of open top pot 154 because the pot and spindle are coupled together for common rotation by guides 184 and splines 168 (FIG. 7). There is also rotation between the bobbin 148 and spindle 160 by the coupling therebetween comprising projections 214 and splines or channels 216.

In operation, open top pot 154 is rotated at a fixed, relatively high rate of speed by rotation of spindle 160 journalled in bolster 158. At the same time, motor 192 is energized so as to rotate at a controlled rate of rotation in accordance with strand tension, as will be described in detail below. Motor shaft 194 rotates bobbin 148 relative to spindle 160 during rotation of the spindle by the external motor. The different rates of rotation of the bobbin 148 and pot 154 cause strand 38 to be wound by strand hook 150 on the bobbin 148.

As aforementioned, the length of the bobbin is traversed by pot 154 as the pot is reciprocated between the upper position shown in solid lines in FIG. 5, and the lower position, shown in dotted lines. More specifically, with rail 156 in the uppermost position, pot 154 is axially supported in the uppermost position as shown, and rotates with spindle 160 within collar 186 on rail 156. In the uppermost position, strand 38 is wound onto the uppermost portion of the bobbin 148.

As the pot 154 is moved downwardly by rail 156 during rotation of the pot, the strand 38 looped under strand hook 150, is gradually moved downwardly toward the lower end of the bobbin 148 until strand hook 150 is in the lowermost position 150′ (dotted line) retaining the strand at the lowermost portion of the bobbin 148. This completes one half cycle of traversing of the bobbin 148.

Rail 156 then proceeds to move upwardly, bringing along with it rotating pot 154, until the pot is again at its uppermost position with hook 150 back in its original position as shown by the solid lines in FIG. 6. At that time, strand 38 is again being wound into the bobbin 148 at the uppermost portion thereof.

The speed of traversing of the strand 38 onto the bobbin 148 depends upon the size of the strand and speed of motor 192, i.e., speed differential between the pot and the bobbin. Preferably, strand 38 is wound onto the bobbin 148 such that the individual turns of strand are located side-by-side without leaving spaces or overcrowding, and successive turns are neatly layered.

It can thus be seen that traversing mechanism 146, forming a second embodiment of the invention, utilizes an axially stationary bobbins and an axially reciprocating pot, with a strand hook mounted on the upper rim of the pot. During rotation, the pot is axially reciprocated along the length of the bobbin while a speed differential between the pot and bobbin is maintained during winding for strand tensioning.

As discussed above, the tension in strand 38 being wound onto bobbin 28 or 148 is controlled by the speed of rotation of motor 47 or 192. In accordance with the present invention, the speed of rotation of motor 47 or 192 is controlled so as to maintain a constant, preselected strand tension. Strand tension in both embodiments is monitored by strand guide members 34. Basically, and as described above with respect to FIG. 1, the guide arm assembly 34 comprises a pair of vertically aligned, stationary guide arms 34*a* and 34*b* having pigtail ends for retaining strand 38 and a tensioning arm 34c, one end of which has a pigtail and the other end of which is mounted to the shaft of a rotary potentiometer 36. As will be described in more detail below, the tension arm 34c is biased out of vertical alignment with the stationary guide arms 34a and 34b by a spring 306. Tension in strand 38 tends to urge tension arm 34c back into vertical alignment with stationary arms 34a and 34b. The angular location of the shaft of potentiometer 36, determined by arm 34c, is indicative of strand tension. The output of potentiometer 36 is calibrated by adjusting the location of a fixed end of the spring, as described below.

Referring now to FIGS. 9–12, one embodiment of a particular tension-to-voltage transducer for monitoring strand tension is described herein for its relative simplicity of design and economy of manufacture. The particular transducer described, however, is not to be construed as restrictive, but rather as illustrative. Numerous other types of tension-to-voltage transducers are known in the art, and any one could be employed herein.

The tension-to-voltage transducer 34 is centered above spindle 30 (see FIGS. 1 and 2) in convenient proximity to delivery rolls 40a and 40b. The incoming strand 38 emerges from the delivery rolls 40a, 40b and feeds through the pigtail ends of strand guides 34a–34c. The shanks of stationary guide arms 34a and 34b lie in the same transverse vertical plane on rail 32. Tension arm 34c is pivotally mounted and when the arm is resting against a stop 290, the tension arm 34c is oriented at a maximum angle $\theta$ with respect to the stationary arms 34a, 34b, as shown in FIG. 9b.

Strand 38, passing through the pigtail end portions of the arms 34a–34c, tends, as tension is applied, to urge the tension arm 34c back into vertical alignment with the stationary arms 34a, 34b.

The shank of tensioning arm 34c is fixed in a side hole 292 in a set collar 294 (FIG. 9a). Set collar 294 is secured to shaft 296 of rotary potentiometer 36 by a set screw 297. The potentiometer 36 is fixedly side mounted to rail 32, and is located thereon such that the axis of rotation of the tension arm 34c, carried by the potentiometer 36, aligns with a plane passing through the shanks of strand guides 34a and 34b with the shank of the tension arm 34c substantially vertically equidistant from the respective shanks of the guides 34a and 34c.

Potentiometer 36 is provided with electrical input leads 298 (see FIGS. 2 and 11) which are connected to external power supply 280 (FIG. 2). Power supply 280 provides constant voltage d.c. power to all the tension-to-voltage transducers as are contained collectively in the individual twisting units of the parent machine 23.

Potentiometer 36 is further provided with an output lead 300 (FIG. 2) which is connected to the motor speed control apparatus or feedback control circuit 282, associated respectively with each twisting unit.

In FIGS. 9(a) and 9(b), the electrical output of potentiometer 36 is a variable voltage d.c. signal proportional to the angle of rotation of shaft 296 of the potentiometer. Radially opposed to the side hole 292 in the set collar 296 is a second hole 304, and fixed therein is the tensioning arm 34d. One end of the extension spring 306 is secured to an eyelet 308 of the tensioning arm 34d, and the remaining end of the spring is secured in a grooved neck of a stud 310. The stud 310 is press-fitted into an elongated rectangular bar 312 (see also FIG. 1) which is slidably contained in elongated guide members 314 (see FIG. 11).

As explained above, the output of potentiometer 36 is controlled by adjusting the "pre-tension" in spring 306. This is done by moving the location of stud 310 relative to the position of the potentiometer 36 and tension arm 34c (FIGS. 9a–9b). As discussed with respect to FIG. 1, the location of studs 310 corresponding to each twisting apparatus is simultaneously adjusted by rotating knob 48 on one end of parent machine 23.

A vertical tang 316 (FIG. 1) is located at one end of bar 312 and is formed integrally thereto by welding, for example. An internally threaded bushing 318 is press-fitted into the tang 316 for receiving the external threads of a lead screw 320. The lead screw 320 also passes through a central clearance hole (not shown) in a flanged journal 322 which is secured, as by bolting, to the outside face of end structure 23 of the parent machine 23. The lead screw 320 then projects into a central through hole 324 in tension adjusting knob 48 and is fixedly secured therein. The larger diameter 326 of knob 48 is knurled, and the smaller diameter 328 is provided with numbered gradiations which, when lined up at various points with respect to a witness mark 330 on journal 322, indicate various strand operating tensions. The knob 48 is graduated to read tension settings in some convenient unit, e.g., ounces of tension.

If, for illustration, it is assumed that the knob 48 is turned in a clockwise direction, and it is further assumed that the threaded bushing 318 has right-hand threads, then bar 312 will be drawn toward the knob, whereas counterclockwise rotation if the knob will reverse the direction of movement of the bar 312. If the bar 312 is thus moved toward or away from knob 48, then all of the studs 310 will move so as to extend (as in FIG. 9b) or allow contraction of (as in FIG. 9a) of springs 306. This extension or contraction will effect a corresponding change of the spring tensions impinging on the tensioning arms 34d.

In practice, the springs 306 will be, by design and construction, of a substantially uniform spring rate and since each of the springs extends or contracts equally with a single movement of the bar 312, such movement will result in an increase or decrease of the spring tensions impinging on the tensioning arm 34d which is substantially equal for each arm. Therefore, a single setting of the tension adjusting knob 48 effects a coordinated and instantaneous change of strand operating tension within a plurality of individual twisting units arranged in parent machine 23.

While FIG. 1 illustrates only one side of parent machine 23 equipped with a group tension control mechanism, the mechanism may be extended to control operating tension on both sides of the parent machine with the tension control input means being in the form of a single control element, such as the knob 48. Thus, in accordance with the invention, single point tension control replaces the ring twister or spinning frames of the prior art in which it is necessary to refit the entire frame with travellers of a different weight whenever it is required to change the operating tension because of a change in the type of stranded material being processed on the frame.

Figure 14:
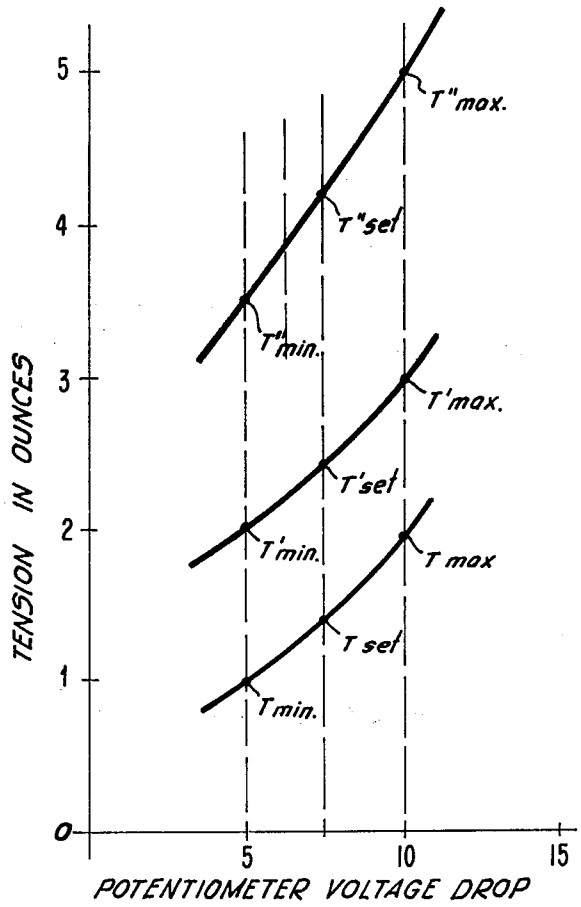
FIG. 14 is a graph illustrating the operation of the spring pre-tensioning mechanism.
Figure 13:
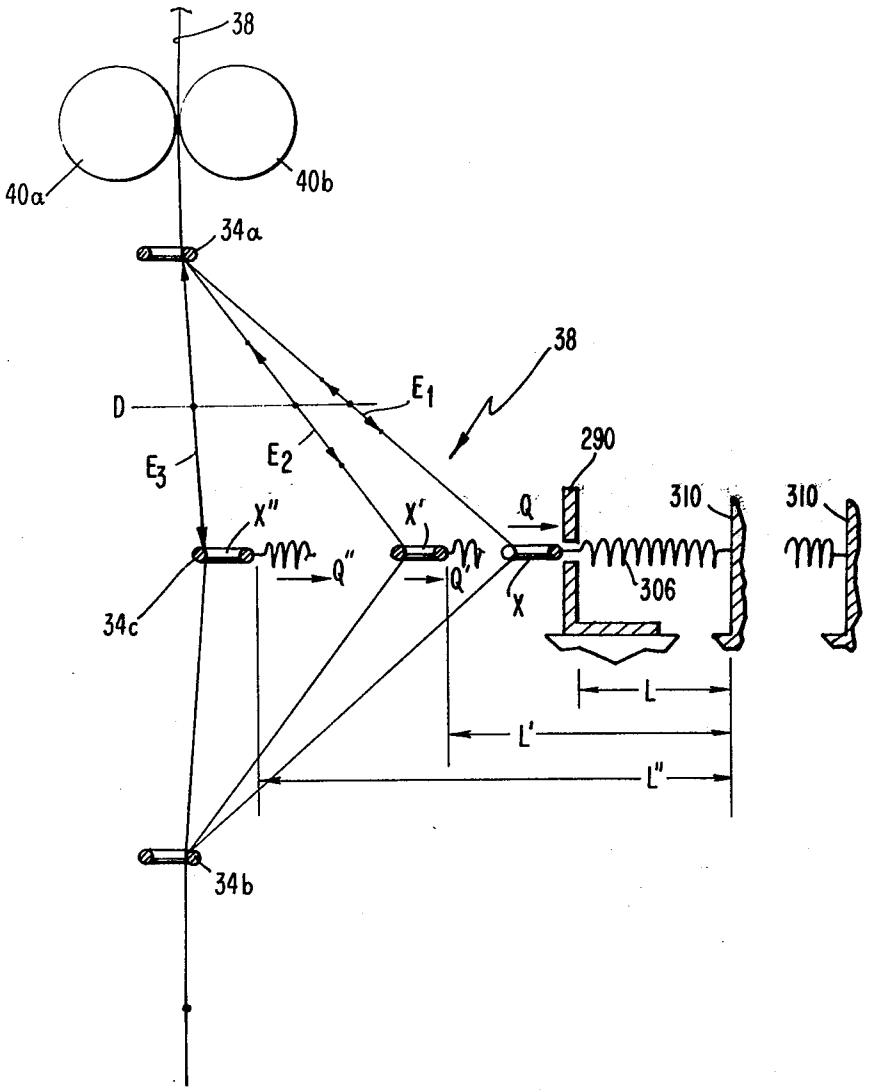
FIG. 13 is a schematic diagram of the spring pretensioning mechanism for explaining calibration.

Referring now to FIGS. 13 and 14, the basic function of the tension-to-voltage transducers on guide members 34 is illustrated in more detail. In FIG. 14, the transfer function or response of the potentiometer 36 operated by tension arm 34c is illustrated graphically, where ounces of tension and output signal in volts are chosen as convenient units for illustration. Transducer (guide mechanism) 34 is preferably calibrated such that a desired tension sensing range (between $T_{min}$ and $T_{max}$ in FIG. 14) will be translated into a corresponding voltage output range (between 5 and 10 volts in FIG. 14) which is contained within the output range of the potentiometer 36.

The tension sensing range is easily shifted by a single mechnical adjustment (knob 48 in the parent machine 23). Such a shift in tension sensing range is indicated in FIG. 14 as a new range lying between $T'_{min}$ and $T'_{max}$ which indicates that the tension sensor has been shifted to a higher tension range without changing the voltage output range of the system.

Referring to FIG. 13, which is an abstraction of certain operating elements in the tension-to-voltage sensor or transducer 34, strand 38 has an upper portion thereof held rigidly in delivery rolls 40*a*, 40*b* and guided through the pig-tails of strand guide arms 34*a*, 34*b* and 34*c* (guides 34*a* and 34*b* are stationary, and guide 34*c* is pivotable about the shaft of the potentiometer 36). One end of spring 306 is connected to the pig-tail on arm 34*c*, and the other end of the spring is anchored to stud 310. Fixed stop 290 prevents any rightward movement of the pig-tail of arm 34*c* beyond the position indicated by X (FIG. 13).

If external loads are applied in stepwise fashion to strand 38 at some point D, as represented in FIG. 13 by loads $E_1$, $E_2$ and $E_3$, corresponding increasing tension levels denoted respectively as $T_{min}$, $T_{set\ point}$, and $T_{max}$ in FIG. 14 will be induced in strand 38. This increasing tension or pull in strand 38 exerts a leftward (FIG. 13) pull on the pig-tail of tensioning arm 34*c*, forcing the arm to leave the position indicated by X and to assume new positions X' and X'' successively.

If the positions X, X' and X'' of the pig-tail of arm 34*c* and angle $\theta$ of the shaft 296 of potentiometer 36 correspond to lengths L, L' and L'' of spring 306, respectively, causing spring forces Q, Q' and Q'', it is obvious that the following chain of proportionalities exit:

$$T \alpha X \alpha L \alpha \theta$$

or $$T \alpha \theta$$

Also, since the rotary input to potentiometer 36 is directly proportional to the output voltage V thereof, and the angular sweep $\theta$ of the potentiometer shaft 296 and tension arm 34*c* is coincident with the rotary input, it follows that $$T \alpha X \alpha \theta \alpha V$$

or $$T \alpha V$$

Although the above proportionalities may be easily deduced and quantified through conventional vector analysis, and while such analysis is useful in the design of specific tension-to-voltage transducers, this type of analysis is not deemed necessary in the present description.

As stated above, the tension sensing range is easily adjusted, whether for a single transducer, or for a plurality thereof adjusted in concert. In order to understand the basic principles of the tension sensing range adjustment means, refer again to FIGS. 9 and 10. FIG. 9*a* corresponds to FIG. 10*a* wherein bar 312 is at a first position with spring 306 extended to a first length when the tensioning arm 34*d* is against stop 290, imparting a first pre-load to the spring. In FIG. 9*b*, corresponding to FIG. 10*b*, stud 310 is moved to the left (in FIG. 9*a*) increasing the length of the spring 306 and correspondingly increasing the pre-load of the spring. In other words, in FIG. 9*b*, it would require a larger force to move the pig-tail of arm 34*c* clockwise. Such larger force, in the present case, corresponds to a higher value of $T_{min}$ as is indicated by $T'_{min}$ in FIG. 14. Of course, $T_{max}$ would also shift to a correspondingly higher value $T'_{max}$ in FIG. 14, thus defining a tension sensing curve in a higher range as shown. If an even higher range were desired, a stiffer spring may have to be substituted for the spring 306, thus shifting the tension sensing curve to the highest level shown in FIG. 14, namely $T''_{min}$ to $T''_{max}$.

The symbol $T_{set\ point}$ in FIG. 14 indicates some strand tension level, set medianly in the tension sensing range, which corresponds to a certain potentiometer output signal, $V_{set\ point}$. A servo system, as described below, uses this $V_{set\text{-}point}$ output as a reference signal and corrects any deviations therefrom by making appropriate adjustments in motor speed, strand take-up rate, strand tension level, tension arm angularity, and potentiometer signal, respectively. The graduations on the tension adjusting knobs 48 in FIG. 1 are calibrated so as to indicate the $T_{set\ point}$ tension levels as a direct reading.

Referring to FIG. 12, the pre-load of spring 306 can be finely adjusted by providing a grooved disc 320 on the shank of stud 310, with an end of spring 306 engaged in the groove. A screw 322 extending through the disc 320 and into a threaded bore in stud 310 is loosened, and the eccentric disc rotated to provide the adjustment. This permits individual adjustment of each of several units as in FIG. 1.

Figure 15:
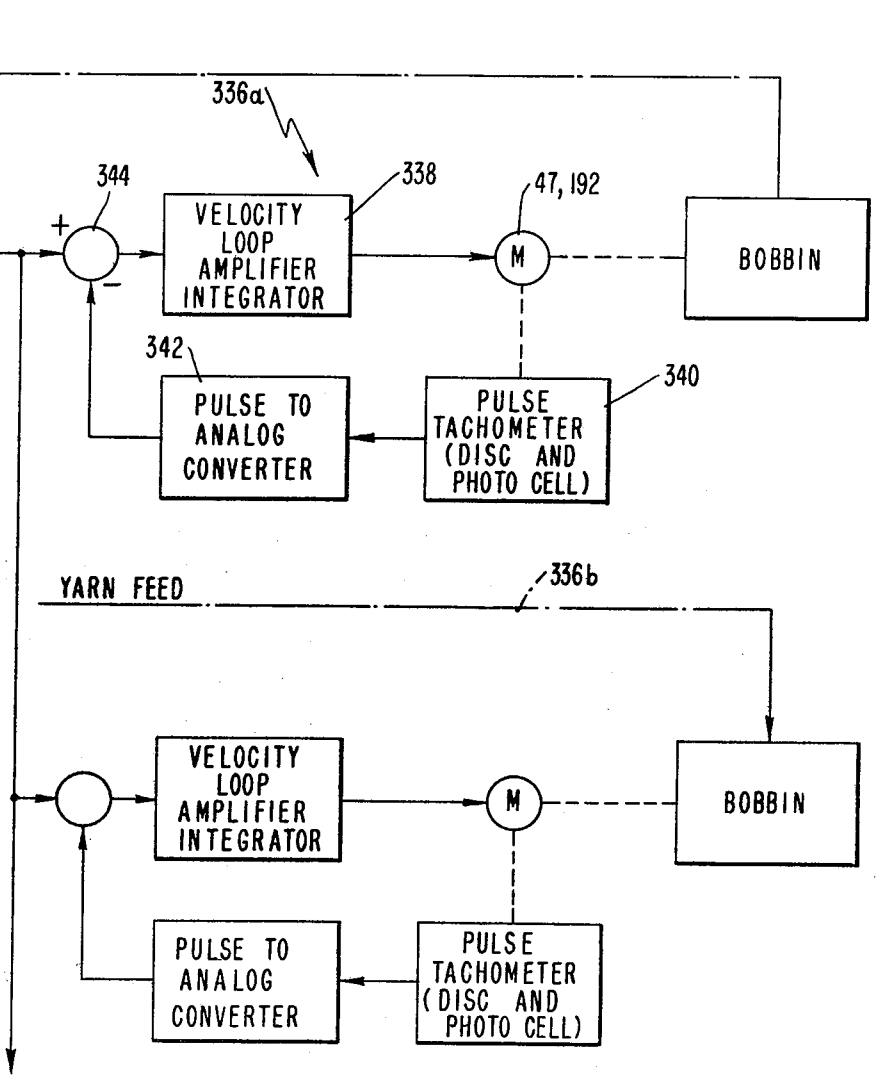
FIG. 15 is a block diagram of a feedback control circuit for controlling a d.c. motor in accordance with one aspect of the invention.
Figure 16:
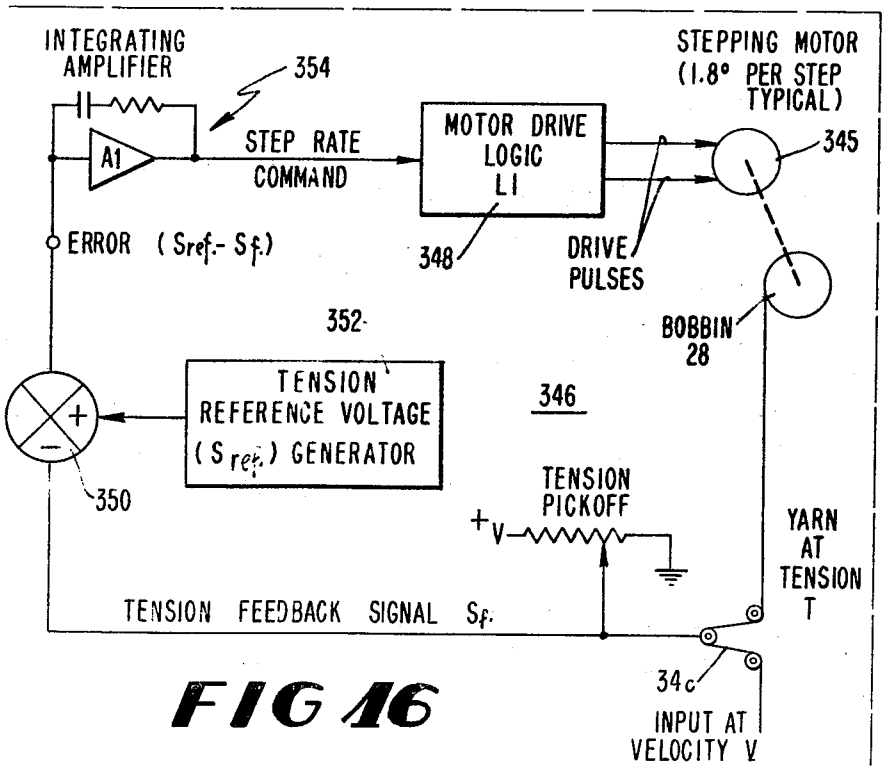
FIG. 16 is a block diagram of a control circuit for controlling a stepping motor in accordance with another aspect of the invention.

FIGS. 15 and 16, respectively, show block diagrams of control circuits for controlling the speeds of a disc armature d.c. motor and a stepping motor for causing relative rotation between the bobbin and open top pots in both embodiments of FIGS. 1–4 and of FIG. 6.

Referring to FIG. 15, a control system for controlling the speed of a d.c. motor functioning as motor 47 in FIG. 2 or motor 192 in FIG. 6 is shown in block diagram form. A tension reference voltage generated by a fixed d.c. source of voltage 330 is supplied to the negative input of a subtractor or difference amplifier 332. The output of tension-to-voltage transducer 34*c* is supplied to the positive input of subtractor 332. The output of subtractor 332 is a voltage that is the difference between the the output of transducer 34*c* and of tension reference voltage generator 330. The output of subtractor 332 therefore represents an error voltage indicative of the error between the actual strand tension measured by the transducer 34*c* and the preselected strand tension indicated by the output of generator 330. The error voltage generated by subtractor 332 is amplified in a tension error amplifier 334.

The output of tension error amplifier 334 is supplied to each of a plurality of motor control circuits 336*a*, 336*b*, . . . , corresponding to each of a plurality of twisting apparatus on parent machine 23 (FIG. 1). Each circuit 336 comprises s velocity control loop including velocity loop amplifier/integrator 338, a tachometer 340, a pulse-to-analog converter 342 and a subtractor 344. The tachometer 340 in the block diagram corresponds to tachometer 270 in FIG. 5.

Considering motor 47 in FIG. 5 in the present example, the speed of the motor is monitored by pulse tachometer 340 (corresponding to tachometer unit 270 in FIG. 5) which generates a signal consisting of a pulse train having a pulse repetition rate proportional to motor speed. The pulse train signal is converted into an analog signal in pulse-to-analog converter 342. The output of converter 342 is supplied to the negative input of subtractor 344 which compares the motor speed with the error signal generated by tension error amplifier 334. Any difference between the speed commanded by the output of tension error amplifier 334 and actual motor speed indicated by converter 342 results in a second error voltage which is applied to the velocity loop amplifier/integrator 338. The second error voltage causes the output of the amplifier/integrator to be corrected so as to drive armature 72 of motor 47 toward a speed appropriate for desired strand tension determined by reference generator 330.

The output of amplifier/integrator 338 is applied to armature 72 of motor 47 through brush unit 266 (FIG. 2). Any difference between the actual strand tension and desired strand tension results in an adjustment of the speed of the armature 72 of motor 47 such that the tension error voltage is nulled.

Referring to FIG. 16, a block diagram of a control circuit for a stepper motor 345 (used as motor 47 or 192 in FIGS. 2 and 6, respectively) is shown. A stepper motor has the advantage that its speed, within appropriate limits, is directly proportional to an input command signal independent of required output shaft torque; the use of a tachometer therefore, is not necessary.

Unlike a standard d.c. motor, a stepping motor increments through a fixed position increment on command from a switching voltage presented to the motor terminals. This switching voltage is usually a simple square wave voltage, and the motor behaves so as to increment one step at the switching points of the square wave. The amplitude of the square wave determines the holding torque capability of the stepper motor, while the frequency of the square wave determines the number of steps per unit time that the motor shaft undergoes. A typical value for the step size is 1.8° for each switching transition. The motor approaches a smooth motion (constant average angular velocity) by presenting the terminals with a switching voltage that is switched at a constant rate or frequency. Additional smoothness or filtering is obtained because of the flywheel action of the load inertia.

Stepper motion control circuit 346 includes a standard stepper motor driver 348 which provides the waveforms necessary to drive the stepper motor at a step rate proportional to an inout analog voltage presented to the input of the motor driver logic. The stator of the stepper motor is secured to the open top pot, such as pot 26, and the output shaft of the motor drives the bobbin (bobbin 28 in FIG. 2) through a driving mechanism (hub 68). Tension-to-voltage transducer 34c monitors strand tension and converts the tension level into a d.c. voltage proportional to the tension, as described in detail above. This signal is labeled $S_f$ in block diagram 346. If $S_f$ is supplied to subtractor 350 that generates an error signal ($S_{ref}-S_f$) which is the difference between a reference signal supplied by generator 352 and the feedback siganl $S_f$. The error signal is then supplied to an integrating amplifier 354 where the tension error signal ($S_{ref}-S_f$) is integrated to produce the step-rate command signal to drive the motor driver logic circuit 348. Motor driver logic circuit 348 is typical of several such circuits well known to those of ordinary skill in the art, such as the Series S1045 driver supplied by Sigma Corporation.

In order to explain the operation of the stepper motor control circuit in block diagram 346, one must define a condition known as steady state operation. This condition is defined as that state when the tension in the yarn is equal to the desired reference tension, and also when the motor velocity is such that the take-up spool accumulates strand at a rate exactly equal to the input feed rate. This is considered steady state because the system would operate indefinitely with no change in strand tension level. Under this condition, zero error is presented to integrating amplifier 354 because $S_f$ equals $S_{ref}$. Therefore, no change in the output of amplifier 354 results. The amplifier 354 simply holds a constant d.c. level necessary to hold the motor velocity constant.

Assume now that with the accumulation of strand 38 on the bobbin 28, the required velocity of motor 47 must decrease to prevent strand tension from increasing because the strand take-up rate is greater than the strand feed rate. As the strand tension increases slightly, the error signal will assume non-zero negative value because $S_f$ is greater than $S_{ref}$. The negative error will cause the output of integrating amplifier 354 to decrease in value from its original steady state value. This will result in slower motor velocity. The motor velocity will continue to decrease until a correct strand tension level is restored in the strand. At this time, the error signal will again be zero and a new residual output from the integrator will maintain proper motor speed to hold the strand tension at the correct level.

In this disclosure, I have shown and described only the preferred embodiments of the invention, but, as aforementioned, it is to be understood that the invention is capable of use in various other combinations and environments and is capable of changes or modifications within the scope of the inventive concept as expressed herein.

For example, although the embodiments described utilize an open top pot for orbiting a strand guide concentrically about a bobbin, along with a traversing mechanism for causing axial reciprocation of the strand guide relative to the bobbin, it is apparent that other arrangements could be provided. As one alternative to the provision of the open top pot for carrying the strand hook, a strand hook carried by a rotatably mounted sleeve could be located concentrically about a bobbin. With the stator of the "pancake" motor rotated by a first motor at a fixed speed, and the strand guide carrying sleeve rotated at the same speed by a timing belt, for example, the rotor of the "pancake" motor rotates the bobbin relative to the strand hook for winding. A conventional traversing mechanism meanwhile vertically reciprocates either the strand hook or bobbin.

As another example, although reference tension adjustment has been described with respect to adjustment of the pretension of spring 306, it is apparent that adjustment could, if desired, be provided electronically by varying the output voltages of tension reference voltage generator 330 (FIG. 15) or tension reference voltage generator 352 (FIG. 16).

What is claimed is:

1. An apparatus for twisting and winding strand by feeding the strand substantially axially onto a rotating strand receiver, comprising:

a spindle, said receiver being removably secured to said spindle;

drive means for rotating said receiver;

strand hook means for guiding the strand onto said receiver;

means for rotating said hook means concentrically to said receiver;

means for imparting axial relative movement between said hook means and said receiver during rotation of said receiver;

means for controlling a differential between the speeds of rotation, respectively, of said guide means and said receiver as a function of the tension of the strand being wound onto said receiver;

said strand receiver comprising a bobbin, and said drive means including a drive member rotatably mounted about said spindle, said bobbin being keyed to said drive member for rotation therewith relative to said spindle;

wherein said spindle and said bobbin are mounted within an open-ended pot along a longitudinal axis thereof and said hook means is located on a wall of said pot;

said open-ended pot being coupled to said spindle for rotation therewith; and means for coupling together said hook means and said pot for common rotation;

said drive member including a hub located beneath said bobbin;

wherein a wall of said pot includes a longitudinal channel, said coupling means including strip means slidably engaged in said channel and carrying said hook means; and said means for imparting axial relative movement between said strip means and said receiver includes means for moving said strip means within said channel during rotation of said pot.

2. An apparatus for twisting and winding strand by feeding the strand substantially axially onto a rotation strand receiver, comprising:

a spindle, said receiver being movably secured to said spindle;

drive means for rotating said receiver;

strand hook means for guiding the strand onto said receiver;

means for rotating said hook means concentrically to said receiver;

means for imparting axial relative movement between said hook means and said receiver during rotation of said receiver;

means for controlling a differential between the speeds of rotation, respectively, of said hook means and said receiver as a function of the tension of the strand being wound onto said receiver;

wherein said strand receiver comprises a bobbin, and said drive means includes a drive member rotatably mounted about said spindle, said bobbin being keyed to said drive member for rotation therewith relative to said spindle;

said spindle and said bobbin being mounted within an open-ended pot along a longitudinal axis thereof and said hook means being located on a wall of said pot;

wherein said open-ended pot is coupled to said spindle for rotation therewith;

wherein said means for rotating said hook means includes first motor means for rotating said spindle at a first speed of rotation; and wherein said receiver rotating means includes second motor means having a rotor and a stator, one of which is coupled to said open-ended pot and the other of which is coupled to said bobbin.

3. The apparatus of claim 1, including an axial bore within said spindle; and a push-rod within said bore, wherein said strip means includes a flexible strip extending through said spindle and said wall channel in said pot along a generally J-shaped path, said strip being secured to said push-rod; and wherein said means for imparting axial relative movement further includes means for reciprocating said push-rod within said bore thereby causing sliding of said strip within said channel.

4. The apparatus of claim 2, wherein said stator is attached to a base of said open-ended pot below said bobbin, and said rotor is coupled to said bobbin.

5. The apparatus of claim 4, wherein said rotor is coupled to a hub located beneath said bobbin and in driving engagement therewith.

6. The apparatus of claim 4, wherein said rotor is coupled to a sleeve rotatably mounted on said spindle, said sleeve being in driving engagement with said bobbin.

7. The apparatus of claim 2, further comprising means for supplying electrical current to said second motor means, including slip ring means on an outer surface of said pot connected to said second motor means, and stationary brush means contacting said slip ring means and carrying said electrical current.

8. The apparatus of claim 2, including speed control means for controlling a speed of rotation of said second motor means.

9. The apparatus of claim 8, wherein said differential speed controlling means includes said speed control means.

10. The apparatus of claim 9, including means for generating an electrical signal indicative of a speed of rotation of the rotor relative to the stator of said second motor means.

11. The apparatus of claim 10 including means for generating a first electrical signal indicative of the actual strand tension in the strand material being wound onto said bobbin.

12. The apparatus of claim 11, including means for generating a second electrical signal indicative of a predetermined tension.

13. The apparatus of claim 12, including comparator means for generating a tension error signal in response to a difference between said first and second electrical signals.

14. The apparatus of claim 13, including circuit means for converting said tension error signal into a speed of rotation error signal; and means responsive to said tension error signal and said speed of rotation indicator signal for supplying the electrical current to drive said second motor means.

15. The apparatus of claim 11, wherein said actual tension signal generating means includes a potentiometer and a movable arm operating said potentiometer and in contact with the strand being wound onto said bobbin, said strand under tension tending to operate said potentiometer.

16. The apparatus of claim 15, including spring means for biasing said movable arm in a first direction counteracting the tension of said strand.

17. The apparatus of claim 16, including means for controlling the force of said spring means for calibration of strand tension.

18. The apparatus of claim 15, further including a pair of stationary guide arms located respectively on opposite sides of said movable arm for positioning said strand with respect to said potentiometer.

19. The apparatus of claim 2, including brush means mounted in said stator and in slidable contact with said rotor, said brush means being supported on leaf spring means for maintaining constant contact pressure between said brush means and said rotor independent of speed of rotation of said rotor.

20. The apparatus of claim 2, wherein said second motor means includes a pancake-type, d.c. motor.

21. The apparatus of claim 2, wherein said second motor means includes a stepper motor.

22. A twisting and winding apparatus comprising:

a spindle;

an open-ended pot having a base and a cylindrical sidewall, said pot being secured to said spindle for rotation therewith;

a strand receiver mounted in said pot for rotation about said spindle;

means for rotating said spindle and said pot;

strand guide means located on the sidewall of said pot for guiding strand onto said rotating receiver;

means for imparting axial relative movement between said guide means and said strand receiver; and an electric motor mounted in said pot for rotating said strand receiver, a differential speed of rotation being established between said receiver and said pot by said motor for tensioning said strand being wound onto said rotating receiver.

23. The apparatus of claim 22, including means responsive to the tension of the strand being wound for controlling the speed of rotation of said motor.

24. The apparatus of claim 22, including drive means rotatably mounted about said spindle, said receiver being mounted concentrically to said drive means and keyed thereto for rotation relative to said spindle.

25. The apparatus of claim 24, wherein said electric motor includes a rotor and a stator, said stator being secured to said pot, and said rotor being coupled to said drive means, rotation of said rotor relative to said stator thereby causing relative rotation between said pot and said receiver.

* * * * *